US007607895B2

(12) United States Patent
Marioni

(10) Patent No.: US 7,607,895 B2
(45) Date of Patent: Oct. 27, 2009

(54) FLUID CIRCULATION PUMP WITH SYNCHRONOUS MOTOR, EQUIPPED WITH HEATING MEANS OF THE FLUID, IN PARTICULAR FOR WASHING MACHINES

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 427 days.

(21) Appl. No.: 11/126,037

(22) Filed: May 10, 2005

(65) Prior Publication Data

US 2005/0260087 A1 Nov. 24, 2005

(30) Foreign Application Priority Data

May 12, 2004 (EP) ..... 04425339

(51) Int. Cl.
*F04B 49/00* (2006.01)

(52) U.S. Cl. ..... 417/20; 417/44.1; 417/32; 417/43

(58) Field of Classification Search ..... 417/44.1, 417/18, 20, 32, 43; 392/308; 361/1, 23
See application file for complete search history.

(56) References Cited

U.S. PATENT DOCUMENTS 5,418,451 A * 5/1995 Maass et al. ..... 324/158.1
2002/0158545 A1* 10/2002 Marioni ..... 310/261

FOREIGN PATENT DOCUMENTS

| | | | |
|---|---|---|---|
| DE | 36 27 732 | A1 | 2/1988 |
| EP | 1 334 689 | A2 | 8/2003 |
| EP | 1 351 375 | A1 | 10/2003 |
| GB | 1 369 658 | A | 10/1974 |
| WO | WO-00/28878 | A | 11/1998 |

* cited by examiner

*Primary Examiner*—Devon C Kramer
(74) *Attorney, Agent, or Firm*—Akerman Senterfitt

(57) ABSTRACT

A fluid circulation pump (10) with synchronous motor (14), equipped with fluid heating device (40), particularly for washing machines or the like, of the type comprising a rotor (18), equipped with a permanent magnet being rotation-driven by the electromagnetic field generated by a stator (15) equipped with pole shoes (20) with the corresponding windings. This pump (10) has also a magnetic flux sensor (22) of the rotor (18) and a control unit (24) a signal from the magnetic flux sensor (22) at least a typical parameter of said fluid and a comparator this parameter with a reference value and to cut the power supply of the fluid heating device (40) off upon reaching a threshold of the predetermined reference parameter.

8 Claims, 4 Drawing Sheets

FLUID CIRCULATION PUMP WITH SYNCHRONOUS MOTOR, EQUIPPED WITH HEATING MEANS OF THE FLUID, IN PARTICULAR FOR WASHING MACHINES

FIELD OF APPLICATION

In its more general aspect the present invention relates to a washing fluid circulation pump driven by a synchronous electric motor, equipped with fluid heating means and particularly, but not exclusively, of the type being incorporated in washing machines and dish-washing machines for civil and industrial use.

In particular, the invention relates to a fluid circulation pump comprising a permanent-magnet synchronous electric driving motor, housed in a pump body being closed by a cover housing the heating means.

The invention relates particularly, but not exclusively, to a fluid circulation pump for dish-washing machines and the following description is made with reference to this field of application for convenience of illustration only.

PRIOR ART

As it is well known to the skilled in the art, the washing fluid of washing machines is drawn by a source, for example the pipeline network, and it undergoes a heating step. This fluid flows in the machine by means of a circulation pump through a delivery opening in a machine washing tank.

During this step, the fluid can be advantageously heated at a temperature being predetermined by a washing program.

There are several prior art solutions to provide for the fluid heating during the step wherein the circulation provides the passage into the pump.

For example, the U.S. Pat. No. 3,051,182 by G. M. Gibson shows a circulation pump equipped with an heating element being incorporated in the impeller chamber, i.e. an element plunging in the fluid itself. More particularly, the heating element arc-wraps the chamber housing the impeller and it is essentially arranged along the fluid recycle path from the pump to the washing tank.

Another solution is described in the German patent no. DE 36277321 by E.G.O. Italiana Spa showing a circulation pump for fluids to be heated comprising an heating area and a pumping area. The heating area comprises heating means arranged for most of the length thereof in the pumping area, thus benefiting from the fluid turbulent flow.

In the several solutions being provided in this patent, particularly FIG. 4 to FIG. 6, heating means can be indifferently arranged inside or outside the pump body in correspondence with the pump pumping area.

A totally similar solution is also described in the international patent application no. WO 00/28878 showing a washing machine circulation pump incorporating an heating element being removably mounted on the pump shell, particularly on the outer part of the volute internally housing the impeller.

All the indicated solutions, although advantageous under several aspects, have the drawback that heating means, generally composed of resistances, are driven by one or more temperature or fluid pressure sensors As it is well known in these applications large resistances are used, which are electrically fed for a reduced heating time, in order to reach the temperature as fast as possible. These resistances have a high resistive value just to heat the fluid to be recycled in less time.

The topologies of resistance generally used to this purpose have a very long hysteresis time and, without thermal exchange, i.e. without any fluid within the body pump, they risk burning irreparably damaging the pump itself.

Obviously, the resistance turn on and off depends on the good operation of temperature and/or pressure sensors.

In the case of pressure sensors, manostats are used, which, plunging in the fluid, must be inserted watertight.

Sensors, both temperature and pressure ones, are generally very delicate from the functional point of view. In fact it happens that they must be replaced after a cut-off intervention of the resistance electric supply. Moreover, a malfunction of these sensors involves that the resistance, not being turned off in time, overheats and thus burns.

Most of the times the replacement of both the sensors and the resistance is not economically profitable, to such an extent that it is preferable to replace the whole pump.

The technical problem underlying the present invention is to provide a synchronous-motor fluid circulation pump, particularly suitable for the installation in washing machines, having such structural and functional features as to allow an effective control and drive of the fluid heating means overcoming the drawbacks cited with reference to prior art solutions.

Another aim of the invention is to realise a pump being capable to achieve said features at very reduced costs and exploiting the scale economies being typical of the products realised on a very large scale.

SUMMARY OF THE INVENTION

The solution idea underlying the present invention is to detect the fluid temperature in the pump and/or the fluid flow rate, avoiding the use of temperature and/or pressure sensors, and to cut the resistance electric supply off once predetermined critical values are reached.

The features and advantages of the circulation pump according to the present invention will be apparent from the following description of an embodiment thereof given by way of non limiting example with reference to the attached drawings.

DETAILED DESCRIPTION

With reference to the figures, a washing fluid circulation pump in washing machines and the like is globally and schematically shown with 10. The pump 10, realised according to the present invention, is equipped with fluid heating means 40 and it is driven by a synchronous electric motor 14.

The pump 10 can be realised in two modes, both falling however in the scope of the present invention.

A first mode provides a pump structure with an electronic control of the electric supply at the motor windings in order to regulate the motor operation in the start-up step and in load variation situations; while a second mode provides a more simplified structure with coupling joints between the rotor and the impeller in order to favour the motor start-up step.

In the electronic control pump hypothesis, a control circuit comprising a power regulation circuit portion and a current regulation circuit portion is associated to the pump permanent-magnet synchronous electric motor.

The kind of control adopted for the power regulation circuit is of the adaptive type, since the voltage applied to the synchronous electric motor windings is adapted to the load and line voltage conditions in order to reach the lowest absorbed power value, for example as described in the European patent application no. 03425409.4 by the same Applicant.

Figure 5:
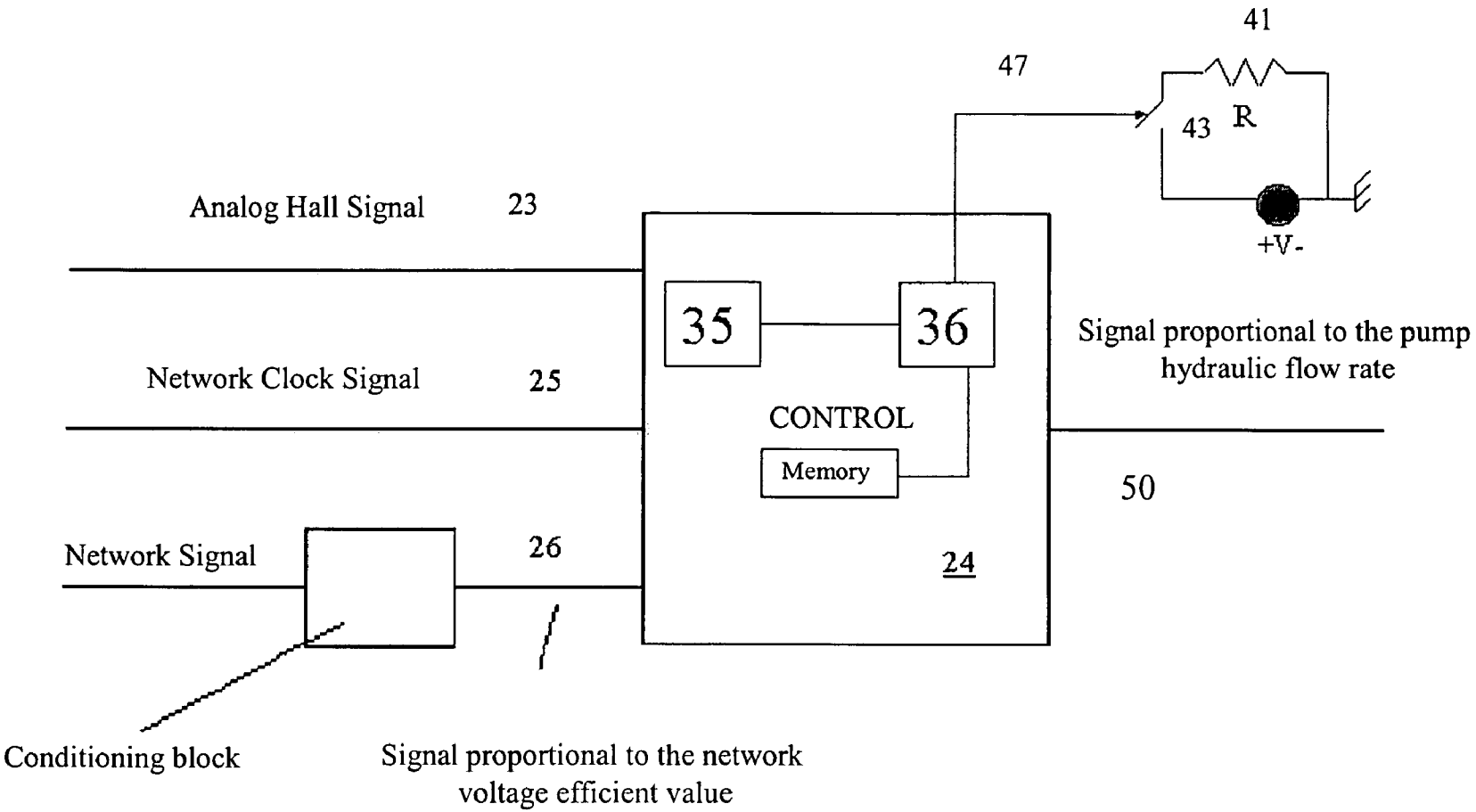
FIG. 5 is a block diagram of a control unit according to the invention to determine the fluid temperature and the fluid presence in a pump driven by a synchronous electric motor.

To the purpose of the present invention the difference between the two pump embodiments is not very relevant but because in the one case the pump is already equipped with an electronic control circuit, while in the other case the pump must be equipped with a control unit, for example as shown in FIG. 5 and describe hereafter.

Figure 1:
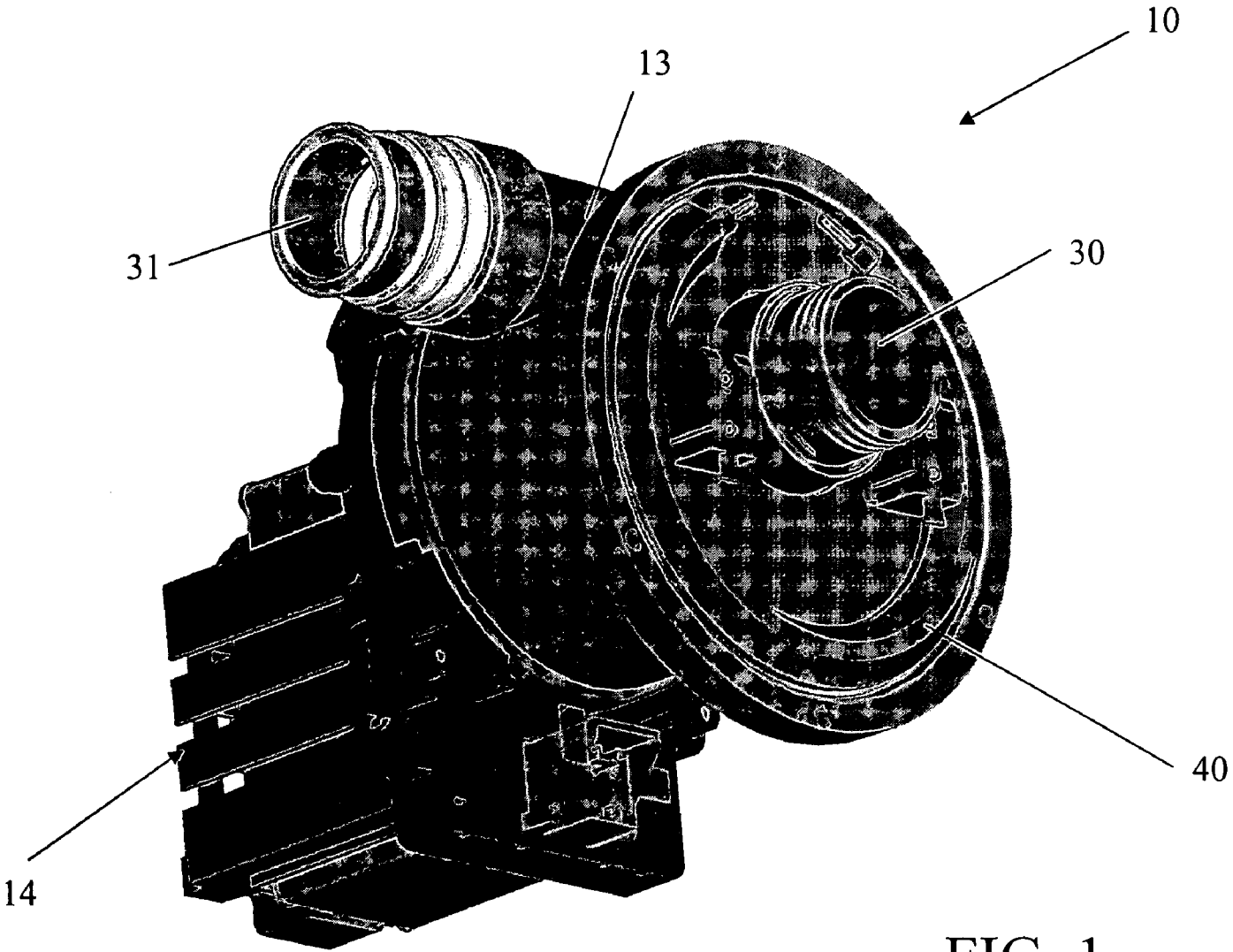
FIG. 1 is a perspective schematic view of the pump according to the invention.
Figure 2:
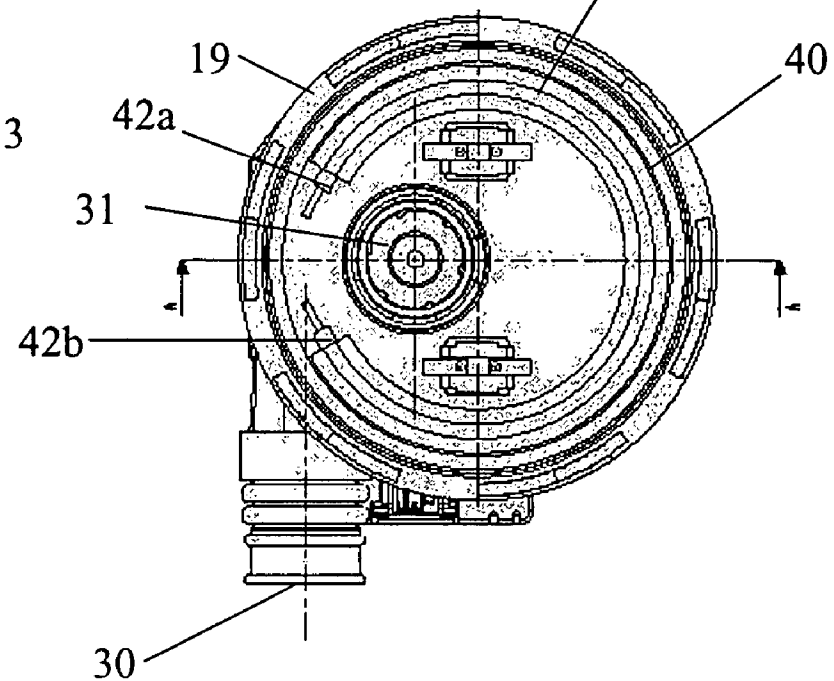
FIG. 2 is a view from above of the pump of FIG. 1.
Figure 3:
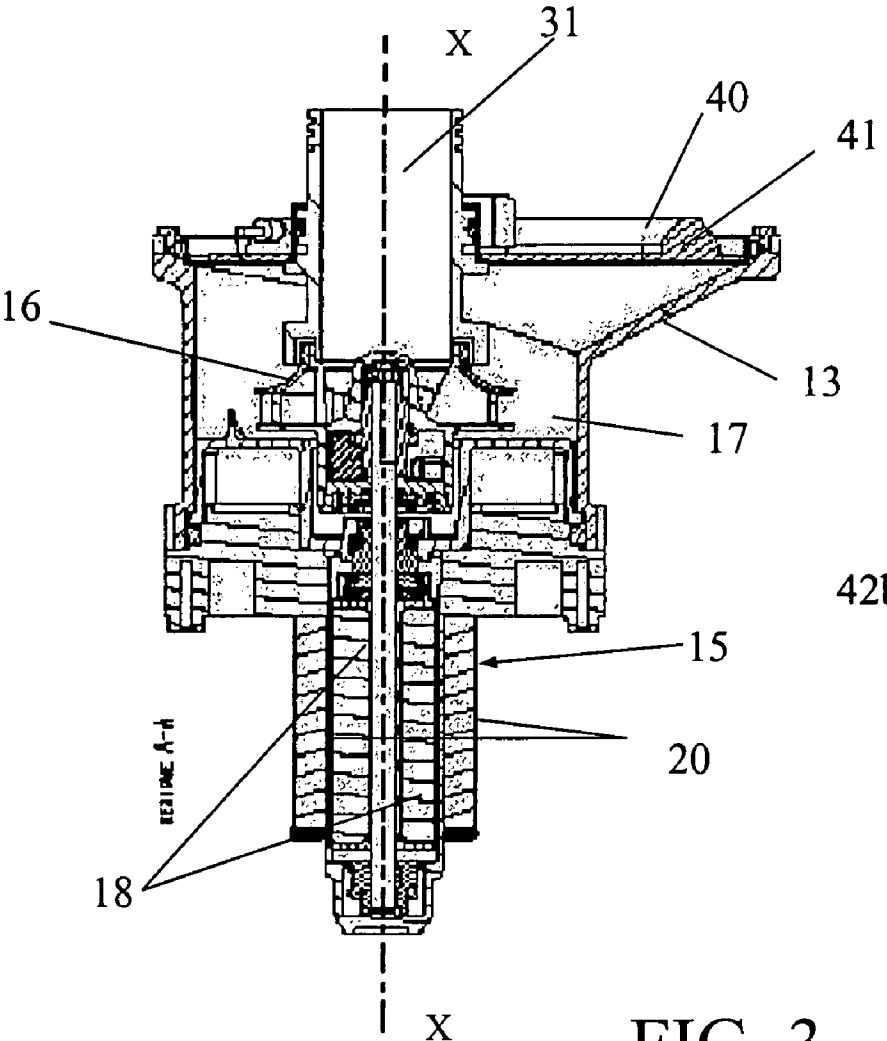
FIG. 3 shows a cross section according to the axis A-A of the pump of FIG. 2.
Figure 4:
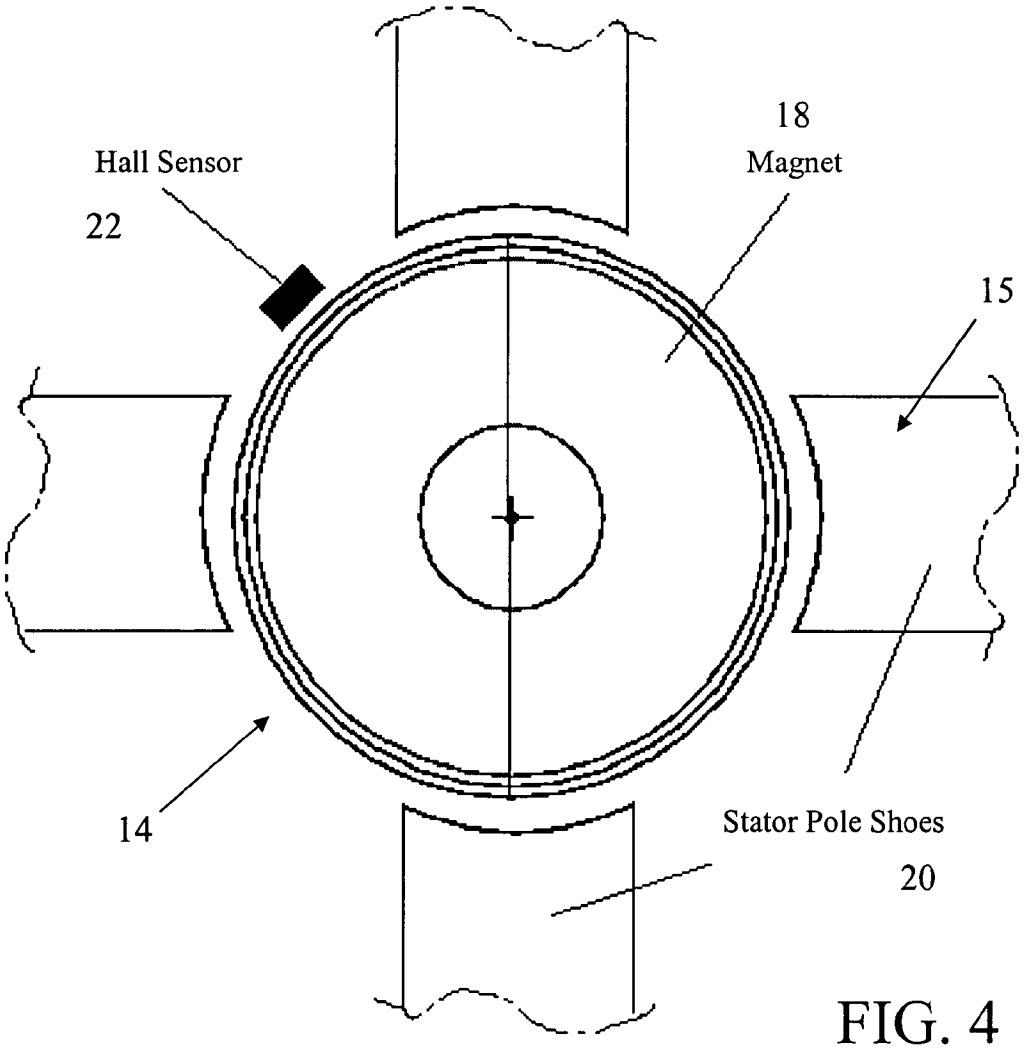
FIG. 4 schematically shows a synchronous electric motor equipped with a permanent magnet according to the invention.

The synchronous motor 14, seen in FIG. 3, and partially in FIG. 4, comprises a stator 15 being centrally crossed by a shell housing the rotor 18. The rotor 18 is a permanent-magnet one and it is insulated tight with respect to the stator 15 by said shell. Said shell is closed at the top by a volute 17 housing an impeller 16.

The rotor 18 is rotation-driven by the electromagnetic field generated by the stator 15, equipped with pole shoes 20 with the relevant windings, and it is integral with a x-x-axis rotation shaft.

Advantageously, as shown in FIG. 4, the synchronous motor 14 comprises a magnetic flux sensor 22 of the rotor 18, for example an analogue Hall sensor, arranged on the stator 15 close to the rotor 18.

The rotation shaft of the synchronous motor 14 is coupled at the top to the impeller 16 by means of a known kinematic coupling, for example as described in the European patent no. 0 983 630 by the same Applicant.

Preferably, the impeller 16 is coaxial to the axis x-x, being arranged in alignment with an end of the rotation shaft.

The synchronous motor 14 comprises a protection pump body 13, preferably of thermoplastic material.

The pump body 13 has sideways to the volute 17, and in correspondence with the impeller 16, a delivery opening 30 communicating with the impeller 16 housing chamber. This delivery opening 30 has preferably an orthogonal axis to the axis x-x and it is arranged tangentially to the volute 17 of the impeller 16. The pump body 13 has also, above the impeller 16, a cover 19 comprising a suction opening 31 wherefrom the fluid pumped by the impeller 16 is sucked through the delivery opening 30. The suction opening 31 has preferably an axis being parallel to the axis x-x.

Externally, the cover 19 houses the heating means 40.

These heating means 40 comprise a ring-shaped, substantially C-shaped, resistance 41, being coaxial to the axis x-x and arranged near the periphery of the cover 19. The resistance is wrapped by a conductive material and in the case indicated in the figure it has a trapezoid cross section, with the larger base arranged near the cover 19 in order to allow a higher contact surface with the cover 19.

The resistance 41 has at the two terminals two clamps 42*a* and 42*b* for the electric connection to the power supply.

Preferably the fluid circulation pump 10 comprises a control unit 24 of the type shown in the block diagram of FIG. 5 which allows the synchronous electric motor 14 to be monitored. When the pump 10 is an electronic control one, the control unit 24 is meant to be incorporated and/or integrated in the pump control circuit. However, the control circuit eventually already existing in order to regulate the electric supply at the motor windings must be equipped with the componentry described hereafter for realising the present invention.

More particularly, a memory portion is associated to the control unit 24 wherein correlation experimental data between the values of an operating variable of the synchronous motor 14 of the pump 10 and the values corresponding to the pump 10 flow rate are stored. An operating variable of the synchronous motor 14, during the steady operation thereof, is the measure of the load or lag angle Θ representing the phase displacement between the voltage applied across the synchronous motor 14 and the counter electromotive force caused by the sum of the effects of the stator 15 flux and of the flux induced by the rotor 18 permanent magnet rotation.

The control unit 24 receives at the input a signal from the analogue Hall sensor 22, relating to the reading of the polarity inversion of the rotor 18 magnet, moreover it receives a network clock signal 25 and a signal being proportional to the effective value of the network voltage 26.

The control unit 24 through a predetermined correlation, in the absence of corrective factors, defines the value of the load or lag angle Θ and a corresponding flow rate value 50.

Advantageously, the rotor 18 plunges in the operating fluid, and in this case the magnet temperature corresponds to the operating fluid one. This dependence is due to the fact that the ferromagnetic material composing the rotor 18 has a residual magnetic induction $B_R$ varying according to the fluid temperature.

The analogue Hall sensor 22 is capable to provide a sinusoidal signal with an amplitude being proportional to the residual induction $B_R$ of the ferromagnetic material composing the rotor 18 and thus to provide the fluid temperature during the passage in the pump 10.

The control unit 24 comprises means 35 allowing the fluid temperature to be drawn from the amplitude of the sinusoidal signal provided by the analogue Hall sensor 22.

Moreover the control unit 24 comprises means 36 to compare the drawn fluid temperature value with a threshold reference value. Upon reaching this threshold reference value the means 36 allow a control signal 47 to be provided at the control unit output for cutting the electric power supply of the heating means 40 off.

The means 36 can conveniently comprise a comparator having at the input the threshold reference value, eventually inserted in the control unit 24 memory, and the signal coming from the means 35. Upon exceeding the threshold reference value the comparator outputs a digital signal 47 which, for example by means of a traditional D/A conversion, allows the operation on a power switch 43 inserted on the power supply line to the resistance 41, interrupting the supply itself. Obviously, nothing prevents the digital signal outputted from the comparator from being directly used to drive an inserted discrete or integrated electronic component as a switch on the power supply line towards the resistance.

As it may be easily understood by a skilled in the art, the signal 47 outputted from the control unit 24 can be also used by the washing machine producer in the hypothesis that heating means are driven by a washing programmer and not by means of switching devices mounted on board of the pump 10.

In other words, the pump 10 can be structured with a power switch 43 in order to independently cut the power supply of the heating means 40 associated thereto off, or it can simply provide, on an output of the control unit 24, and thus of the electronic circuit incorporating it, an analogue or digital electric signal 47 to be used in order to cut the power supply to the heating means 40 off by means of an external control unit, for example a washing machine programmer.

Moreover, advantageously, the control unit 24 of the pump 10 can detect the fluid within the pump 10 through the value outputted from the control unit 24, i.e. the pump 10 flow rate. Thus, through the means 36, the control unit 24 can compare the drawn value of the flow rate 50 with a threshold reference value, which in this case is conveniently a value near to zero. Upon reaching this threshold reference value, and thus without any fluid, the means 36 allow the electric power supply to the resistance 41 to be cut off.

The main advantage reached by the present invention is to allow the fluid heating means to be controlled in a simple and reliable way, avoiding the use of temperature and pressure sensors.

The synchronous motor pump controlled by the control unit as previously described can undergo some modifications, all within the reach of the skilled in the art and falling within the scope of protection of the present invention, as defined in the following claims.

The invention claimed is:

1. A fluid circulation pump with synchronous motor, equipped with fluid heating means, for washing machines, said fluid circulation pump comprising:

a stator equipped with pole shoes with corresponding windings;

a rotor, partially plunging in an operating fluid and equipped with a permanent magnet that is rotation-driven by an electromagnetic field generated by the stator, wherein said rotor is insulated tight with respect to said stator by a shell closed at a top thereof by a volute housing an impeller for the operating fluid circulation; and a magnetic flux sensor of said rotor, a control unit equipped with drawing means to draw, by a signal provided from said magnetic flux sensor, parameters of a temperature and a flow rate of said operating fluid, and comparing means to compare said parameters with a reference value and to output an electric signal to be used to cut off a power supply of said fluid heating means upon reaching a threshold of said parameters.

2. A fluid circulation pump according to claim 1, wherein said magnetic flux sensor is an analogue Hall sensor.

3. A fluid circulation pump according to claim 2, wherein said rotor comprises ferromagnetic material which has a residual magnetic induction $B_R$, varying according to the temperature of said operating fluid, and wherein said analogue Hall magnetic flux sensor outputs a sinusoidal signal with a proportional amplitude to said residual magnetic induction $B_R$.

4. A fluid circulation pump with synchronous motor, equipped with fluid heating means, said fluid circulation pump comprising:

a stator equipped with pole shoes with corresponding windings;

a rotor equipped with a permanent magnet that is rotation-driven by an electromagnetic field generated by the stator;

a magnetic flux sensor of said rotor; and a control unit equipped with drawing means to draw by a signal provided from said magnetic flux sensor, at least one parameter of an operating fluid, and comparing means to compare this parameter with a reference value and to output an electric signal to be used to cut off a power supply of said fluid heating means upon reaching a threshold of said at least one parameter, wherein said at least one parameter of said operating fluid is drawn from a presence of the operating fluid in said fluid circulation pump, wherein said control unit comprises a memory portion wherein correlation experimental data between the values of an operating variable of the synchronous motor and the values corresponding to a pump flow rate are stored, said operating variable of the synchronous motor being the measure of a load or lag angle Θ representing the phase displacement between a voltage applied across the synchronous motor and a counter electromotive force caused by a sum of effects of a stator flux and of a flux induced by a rotor permanent magnet rotation, drawn by the magnetic flux sensor, and wherein the fluid presence in said fluid circulation pump is detected by an output signal of said control unit being proportional to said measure of the load or lag angle Θ and to the pump flow rate.

5. A fluid circulation pump with synchronous motor, equipped with fluid heating means, said pump comprising:

a stator equipped with pole shoes with corresponding windings;

a rotor equipped with a permanent magnet that is rotation-driven by an electromagnetic field generated by the stator;

a magnetic flux sensor of said rotor, wherein said magnetic flux sensor is an analogue Hall sensor; and a control unit equipped with drawing means to draw, by the signal provided from said magnetic flux sensor, at least one parameter of an operating fluid, and comparing means to compare this parameter with a reference value and to output an electric signal to be used to cut a power supply of said fluid heating means off upon reaching a threshold of said parameter, wherein said drawing means comprise a device that is capable of drawing a temperature value of said operating fluid from a sinusoidal signal coming from said analogue Hall sensor;

wherein said comparing means comprise an analogue digital comparator allowing a temperature and/or a fluid presence to be compared with the reference value and an output signal being capable to interrupt the power supply of said fluid heating means to be generated upon exceeding said reference value; and wherein said output signal of said comparing means is a digital signal and operates on a switch inserted on a power supply line to said fluid heating means.

6. A fluid circulation pump according to claim 1, wherein said control unit is incorporated in an electronic circuit for controlling and regulating a power supply at the motor windings.

7. A fluid circulation pump according to claim 1, wherein said control unit is integrated in an electronic control circuit and has a signal output belonging to outputs of said electronic control circuit.

8. A fluid circulation pump according to claim 1, wherein said fluid circulation pump comprises a pump body with a cover housing said fluid heating means.

* * * * *